US010448683B2

(12) United States Patent
Hoverter et al.

(10) Patent No.: US 10,448,683 B2
(45) Date of Patent: Oct. 22, 2019

(54) ATHLETIC GARMENT FOR CYCLING

(71) Applicant: DashAmerica, Inc., Louisville, CO (US)

(72) Inventors: Lori Hoverter, Denver, CO (US); Melodie Miller, Longmont, CO (US); Keegan Rehfeldt, Beaverton, OR (US)

(73) Assignee: DASHAMERICA, INC., Louisville, CO (US)

( * ) Notice: Subject to any disclaimer, the term of this patent is extended or adjusted under 35 U.S.C. 154(b) by 134 days.

(21) Appl. No.: 15/702,592

(22) Filed: Sep. 12, 2017

(65) Prior Publication Data

US 2019/0075859 A1 Mar. 14, 2019

(51) Int. Cl.

*A41D 13/02* (2006.01)
*A41F 15/00* (2006.01)
*A41D 1/084* (2018.01)

(52) U.S. Cl.

CPC ..... *A41D 13/02* (2013.01); *A41D 1/084* (2013.01); *A41F 15/00* (2013.01); *A41D 2600/104* (2013.01)

(58) Field of Classification Search

CPC .... A41D 13/02; A41D 2600/104; A41D 1/08; A41D 1/084; A41D 7/00; A41D 2600/10; A41D 1/00; A41D 1/083; A41F 15/00; A41F 15/02; A41B 9/00; A41B 9/08

USPC ..... 2/79, 67, 69; D2/731

See application file for complete search history.

(56) References Cited

U.S. PATENT DOCUMENTS 1,439,100 A * 12/1922 Hatch ..... A41B 9/08 2/78.1
1,454,477 A * 5/1923 Lambert ..... A41B 9/08 2/78.2
1,909,279 A * 5/1933 Just ..... A41D 7/00 2/67

(Continued)

FOREIGN PATENT DOCUMENTS

GB 2491137 A 11/2012
WO 2015058276 A1 4/2015

OTHER PUBLICATIONS

International Search Report and Written Opinion issued in PCT/US18/50293 dated Nov. 2, 2018.

(Continued)

*Primary Examiner* — Anna K Kinsaul
*Assistant Examiner* — F Griffin Hall
(74) *Attorney, Agent, or Firm* — Jeffer Mangels Butler & Mitchell LLP; Brennan C. Swain, Esq.

(57) ABSTRACT

A garment that includes a bottom portion having first and second leg openings, a front part and a back part, first and second shoulder straps that each have a front portion extending upwardly from the front part and a back portion extending upwardly from the back part. The first and second shoulder straps each include a shoulder portion that connects the front portion to the back portion. The back portion of the first shoulder strap includes an upper section and a lower section and the lower section is wider than the upper section. The back portion of the second shoulder strap includes an upper section and a lower section and the lower section is wider than the upper section. At least a portion of the lower section of the first shoulder strap overlaps at least a portion of the lower section of the second shoulder strap.

12 Claims, 4 Drawing Sheets

(56) References Cited

U.S. PATENT DOCUMENTS

| | | | | |
|---|---|---|---|---|
| 1,957,102 | A * | 5/1934 | Earnshaw | A41D 7/00 2/67 |
| 3,348,237 | A * | 10/1967 | Simonoff | A41D 15/00 2/74 |
| 5,189,736 | A * | 3/1993 | Price | A41D 13/0017 2/67 |
| 6,766,533 | B1 * | 7/2004 | Meier | A41D 7/00 2/67 |
| 7,306,505 | B2 * | 12/2007 | Barbour | A41C 3/0057 2/DIG. 2 |
| D641,958 | S | 7/2011 | Waldman | |
| 9,456,640 | B2 * | 10/2016 | Kemma | A41D 1/084 |
| 2006/0272069 | A1 | 12/2006 | Sheetz | |
| 2006/0277645 | A1 * | 12/2006 | Okajima | A41D 1/084 2/69 |
| 2012/0073028 | A1 * | 3/2012 | Knopik | A41D 1/084 2/79 |
| 2012/0185992 | A1 * | 7/2012 | Byrnes | A41D 7/00 2/67 |
| 2014/0096301 | A1 * | 4/2014 | Waller | A41D 7/00 2/67 |
| 2015/0201682 | A1 * | 7/2015 | Musciacchio | A41D 7/005 2/67 |
| 2015/0351466 | A1 * | 12/2015 | Asnis | A41D 27/10 2/69 |
| 2016/0316825 | A1 * | 11/2016 | Cutler | A41D 1/084 |
| 2017/0079339 | A1 * | 3/2017 | Yeomans | A41D 7/005 |
| 2017/0172224 | A1 * | 6/2017 | Joseph | A41D 7/005 |

OTHER PUBLICATIONS

Amazon.com, "ONeill Women's James One Piece Swimsuit" [online] Sep. 5, 2017 (Sep. 5, 2017), retrieved from the internet on Nov. 9, 2018) ,URL https://www.amazon.com/O'Neill-Women-James-Piece-Swimsuit/dp/B074BJJJMB.; Entire document.

* cited by examiner

ATHLETIC GARMENT FOR CYCLING

FIELD OF THE INVENTION

The invention relates to bicycle clothing, and more particularly to bicycle clothing that includes shoulder straps that cross in the back.

BACKGROUND OF THE INVENTION

Some bicycle clothing, such as bibs and other one-piece garments, include shoulder straps that go over the shoulders to hold up the bottom portion of the garment. However, when the cyclist has to use the bathroom they must remove the shoulder straps to lower the bottom portion of the garment. Because bibs are often worn under other clothing this can make it difficult to use the bathroom. As a result, a need exists for a bicycle garment that overcomes the issue.

SUMMARY OF THE PREFERRED EMBODIMENTS

The present invention is an athletic garment that includes first and second shoulder straps that overlap in the back and allow a user to lower the back of the garment so they can use the bathroom without having to remove the shoulder straps.

In accordance with a preferred embodiment of the present invention there is provided a garment that includes a bottom portion having first and second leg openings, a front part and a back part, first and second shoulder straps that each have a front portion extending upwardly from the front part and a back portion extending upwardly from the back part. The first and second shoulder straps each include a shoulder portion that connects the front portion to the back portion, The back portion of the first shoulder strap includes an upper section and a lower section and the lower section is wider than the upper section. The back portion of the second shoulder strap includes an upper section and a lower section and the lower section is wider than the upper section. At least a portion of the lower section of the first shoulder strap overlaps at least a portion of the lower section of the second shoulder strap. In a preferred embodiment, the lower sections of the first and second shoulder straps are connected to the bottom portion along a common seam. Preferably, the lower sections of the first and second shoulder straps are not secured together.

In a preferred embodiment, the garment includes a back bridge connecting the back portion of the first shoulder strap to the back portion of the second shoulder strap. Preferably, the back portion of the first shoulder strap and the back portion of the second shoulder strap each include an inner edge and the back bridge includes a lower edge. The inner edge of the back portion of the first shoulder strap, the lower edge of the back bridge and the inner edge of the back portion of the second shoulder strap form a criss-cross open edge. Preferably, the criss-cross open edge includes a first end and a second end, the common seam includes a first end and a second end, the first end of the criss-cross open edge coincides with the first end of the common seam and the second end of the criss-cross open edge coincides with the second end of the common seam.

In a preferred embodiment, the lower sections of the first and second shoulder straps become gradually wider closer to the bottom portion. Preferably the lower section of the back portion of the first shoulder strap includes an inner edge and an outer edge and the inner edge forms an angle between approximately 70° and approximately 75° with the common seam, and the lower section of the back portion of the second shoulder strap includes an inner edge and an outer edge, and the inner edge forms an angle between approximately 70° and approximately 75° with the common seam.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
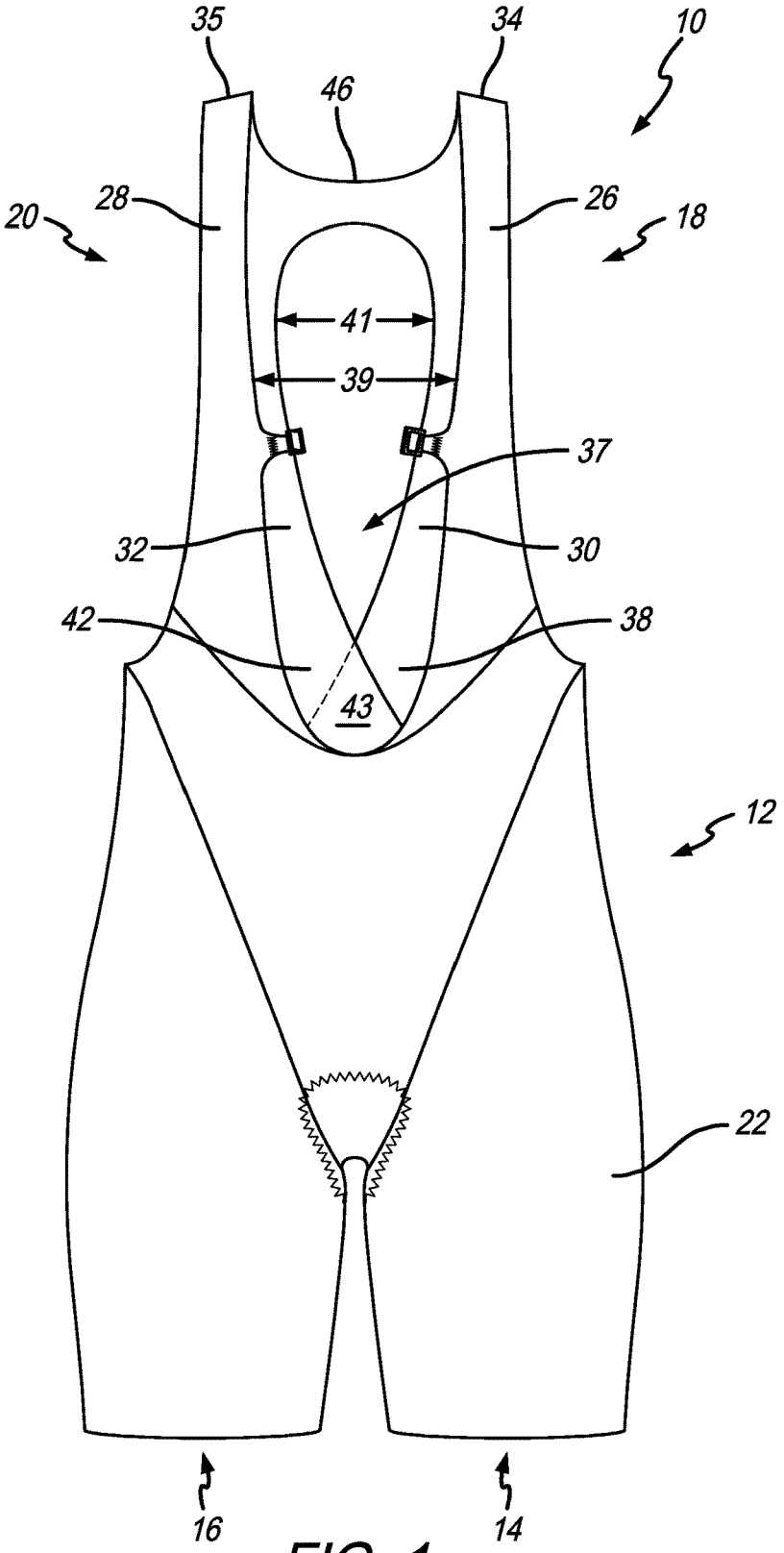
FIG. 1 is a front elevational view of a garment in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "upper," "lower," "side," "short," "long," "up," "down," and "below" used herein are merely for ease of description and refer to the orientation of the components as shown in the figures. It should be understood that any orientation of the components described herein is within the scope of the present invention.

Referring now to the drawings, wherein the showings are for purposes of illustrating the present invention and not for purposes of limiting the same, FIGS. 1-4 show an athletic garment 10 in accordance with a preferred embodiment of the present invention. As shown in FIGS. 1-4, the garment 10 generally includes a bottom portion 12 that includes first and second leg openings 14 and 16 and first and second shoulder straps 18 and 20 extending upwardly from the bottom portion 12. The drawings show a bib or garment 10 with short length leg portions. It will be appreciated that the garment can also have full length or pant length leg portions.

Figure 2:
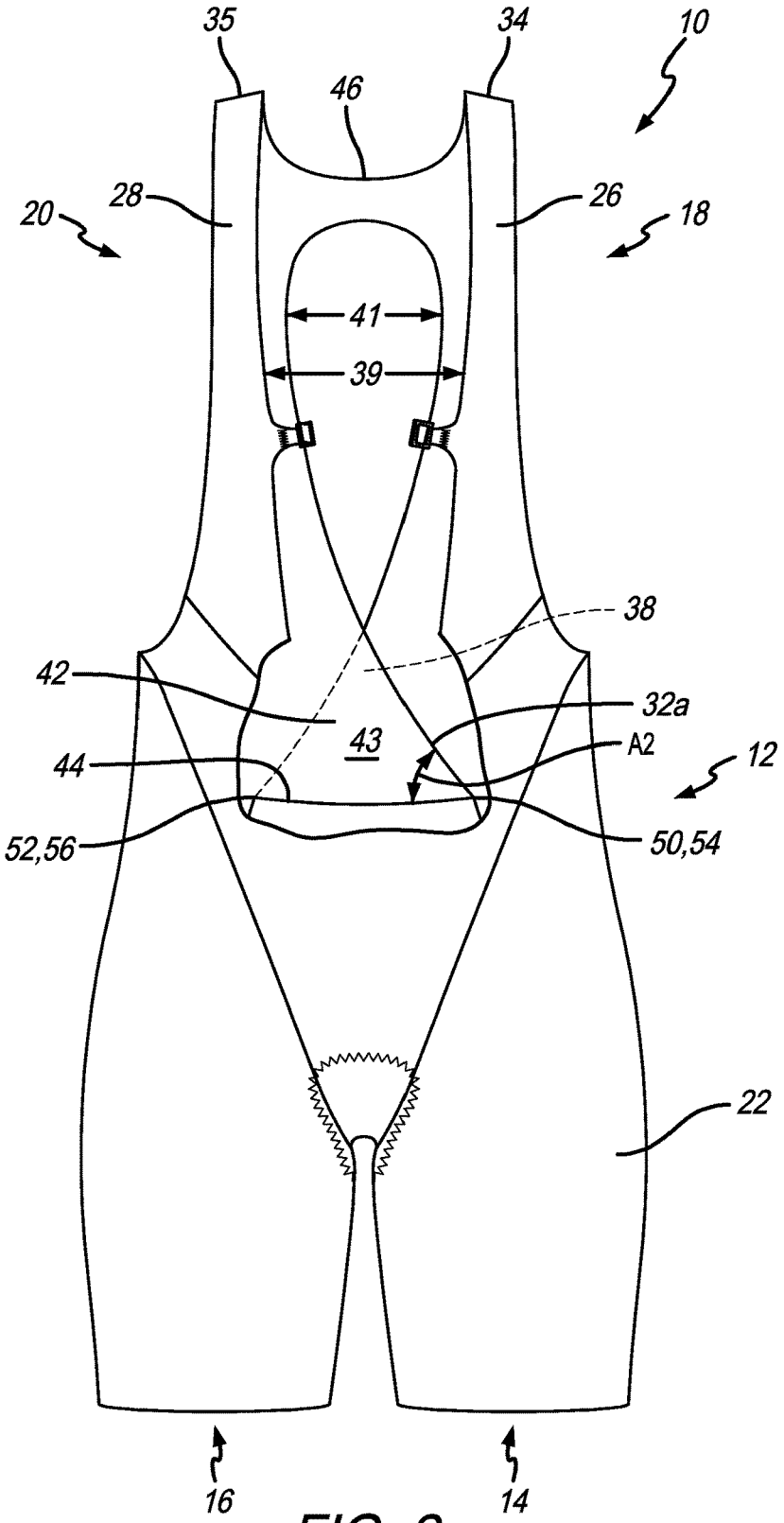
FIG. 2 is a front elevational view of the garment of FIG. 1 with a portion of the front cut away to reveal where the shoulder straps connect to the back.

The bottom portion 12 includes a front part 22 and a back part 24. The first and second shoulder straps 18 and 20 each have a front portion 26 and 28, respectively, extending upwardly from the front part 22 and a back portion 30 and 32, respectively, extending upwardly from the back part 24. The first and second shoulder straps 18 and 20 also each include a shoulder portion 34 and 35, respectively, that connect the front portion 26 and 28 to the back portion of each shoulder strap. The back portions 30 and 32 of the first and second shoulder straps 18 and 20 define a back strap gap 41 therebetween and the front portions 26 and 28 of the first and second shoulder straps 18 and 20 define a front strap gap 39 therebetween. In a preferred embodiment, the back strap gap 41 at the position shown by the arrows in FIG. 2 is approximately 5 cm to approximately 10 cm and the front strap gap 39 at the position shown by the arrows in FIG. 2 is approximately 10 cm to approximately 20 cm. In another embodiment, both the front and back strap gaps can be larger or smaller. The bottom portion 12 together with the first and second shoulder straps 18 and 20 define a wearer space 37 therein.

Figure 3:
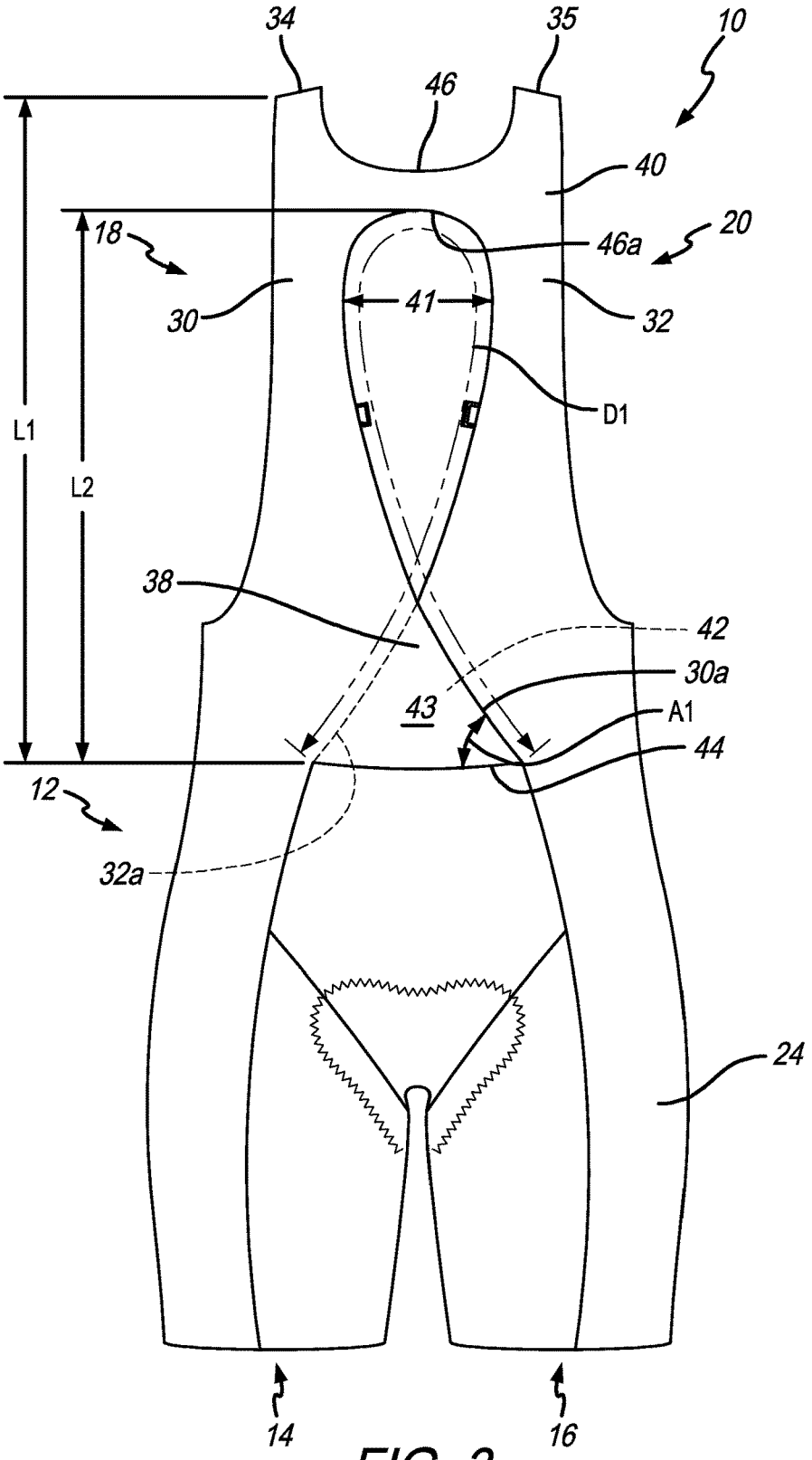
FIG. 3 is a rear elevational view of the garment of FIG. 1.
Figure 4:
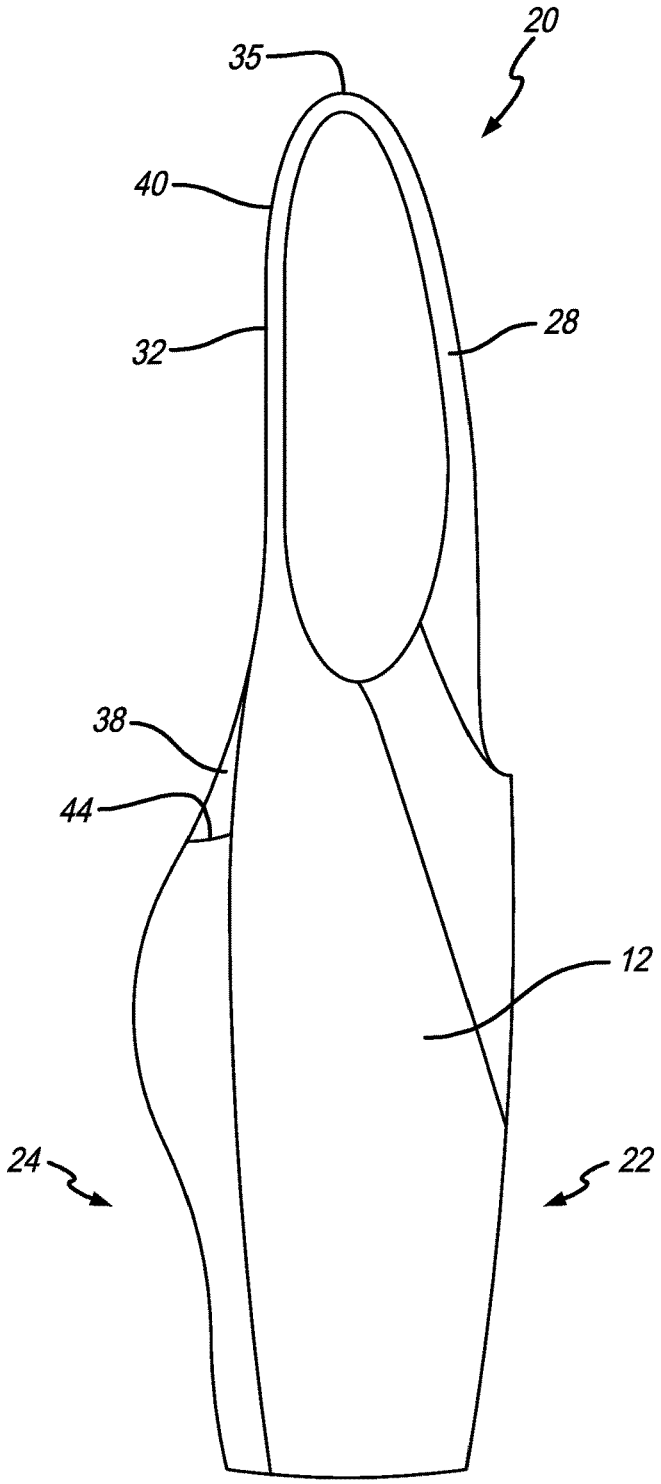
FIG. 4 is a side elevational view of the garment of FIG. 1.

As shown in FIG. 3, the back portion 30 of the first shoulder strap 18 includes an upper section 36 and a lower section 38 and the back portion 32 of the second shoulder strap 20 includes an upper section 40 and a lower section 42. In a preferred embodiment, the lower sections 38 and 42 are wider than the upper sections 36 and 40. Preferably, the lower sections 38 and 42 of the back portions 30 and 32 of the first and second shoulder straps 18 and 20 become gradually wider closer to the bottom portion 12. In other words, the back portions 30 and 32 of the first and second shoulder straps 18 and 20 taper in an upward direction. As shown in FIGS. 1-3, in a preferred embodiment, at least a portion of the lower section 38 of the first shoulder strap 18 overlaps at least a portion of the lower section 42 of the second shoulder strap 20. The overlapping area is referred to herein as the overlap section 43 and is shown in FIGS. 2-3.

As shown in FIGS. 2-3, in a preferred embodiment, the lower sections 38 and 42 of the back portions 30 and 32 of the first and second shoulder straps 18 and 20 are connected to the bottom portion 12 along a common seam 44. In another embodiment, the lower sections 38 and 42 of the back portions 30 and 32 of the first and second shoulder straps 18 and 20 can be connected to the bottom portion 12 along different seams. Preferably, the lower sections 38 and 42 of the back portions 30 and 32 of the first and second shoulder straps 18 and 20 are not secured together, other than possibly along the common seam. More specifically, in a preferred embodiment, the lower sections 38 and 42 of the back portions 30 and 32 of the first and second shoulder straps 18 and 20 are not secured together within the overlap section 43. It will be appreciated by those of ordinary skill in the art that this feature is what allows the back of the garment 10 to be lowered so that wearer can use the bathroom.

In a preferred embodiment, the garment includes a back bridge 46 connecting the back portion 30 of the first shoulder strap 18 to the back portion 32 of the second shoulder strap 20 and spanning the back strap gap 41. The back bridge 46 helps prevent the first and second shoulder straps 18 and 20 from sliding or rolling off the wearer's shoulders when the back of the garment is lowered.

In a preferred embodiment, the common seam 44 is approximately between about approximately 1 cm and approximately 20 cm in length. In a more preferred embodiment, the common seam 44 is approximately between about approximately 5 cm and approximately 18 cm in length. In a most preferred embodiment, the common seam 44 is approximately between about approximately 10 cm and approximately 15 cm in length. In another embodiment, the common seam 44 can wrap around to the front of the garment. In such a case the common seam 44 would be longer than the dimensions given herein.

The first shoulder strap 18 includes an inner edge and an outer edge and the second shoulder strap 20 includes an inner edge and an outer edge. As shown in FIG. 3, the inner edge 30*a* of the lower section 38 of the back portion 30 of the first shoulder strap 18 forms an angle A1 with the common seam 44. In a preferred embodiment, the angle A1 is between about 60° and about 80°, in a more preferred embodiment, the angle A1 is between about 65° and about 77°, and in a most preferred embodiment, the angle A1 is between about 70° and about 75°. Similarly, as shown in FIG. 2, the inner edge 32*a* of the lower section 42 of the back portion 32 of the first shoulder strap 20 forms an angle A2 with the common seam 44. In a preferred embodiment, the angle A2 is between about 60° and about 80°, in a more preferred embodiment, the angle A2 is between about 65° and about 77°, and in a most preferred embodiment, the angle A2 is between about 70° and about 75°. In a preferred embodiment, A1 and A2 are approximately the same. However, in another embodiment, A1 and A2 are different.

The total length of the inner edges 30*a* and 32*a* of the back portions 30 and 32 of the shoulder straps 18 and 20 together with the lower edge 46*a* of the back bridge 46 is referred to herein as the criss-cross open edge and is shown in FIG. 3 by the double ended arrow labeled D1. The length of the criss-cross open edge D1 is what allows the bottom of the bib to be lowered so that the wearer can use the bathroom.

Moreover, the length of the criss-cross open edge D1 (and all of the dimensions given herein) are dependent on the intended wearer. For example, the dimension will change if the bib is intended to be worn by a toddler or a male with a 50" waist. The dimensions given herein are for typical sized adults. It will be appreciated that the dimensions are not limiting. The dimension of D1 is determined by the distance from the high shoulder point to the common seam 44 (shown as L1 in FIG. 3) and the distance from the bottom edge of the bridge 46*a* to the common seam 44 (shown as L2 in FIG. 3). In a preferred embodiment, L1 is between approximately 45 cm and approximately 55 cm and L2 is between approximately 42 cm and approximately 54 cm. In a preferred embodiment, the bib is made of a material that stretches (e.g., it includes spandex or the like). In a preferred embodiment, the length of D1 is between approximately 50 cm and approximately 110 cm when relaxed (not stretched) and between approximately 156 cm and approximately 161 cm when fully stretched. In a most preferred embodiment, the length of D1 is between approximately 70 cm and approximately 90 cm when relaxed (not stretched) and between approximately 136 cm and approximately 141 cm when fully stretched. Dimensions outside these ranges are within the scope of the present invention.

As shown in FIG. 2, the criss-cross open edge D1 includes a first end 50 and a second end 52 and the common seam 44 includes a first end 54 and a second end 56. In a preferred embodiment, the first end 50 of the criss-cross open edge D1 coincides with the first end 54 of the common seam 44 and the second end 52 of the criss-cross open edge D1 coincides with the second end 56 of the common seam 44.

As shown in the figures, the garment 10 is made of a number of sections that are secured together along seams. It will be appreciated by those of ordinary skill in the art that the number of sections and seams is not a limitation on the present invention. The garment 10 can be made from a single piece of fabric or from any different number of pieces of fabric secured together along seams.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further any specific numbers noted herein are only examples: alternative implementations may employ differing values or ranges.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A garment for use by a wearer having left and right shoulders, the garment comprising:

a bottom portion that includes first and second leg openings, wherein the bottom portion includes a front part and a back part, first and second shoulder straps that each have a front portion extending upwardly from the front part and a back portion extending upwardly from the back part, wherein the first and second shoulder straps each include a shoulder portion that connects the front portion to the back portion, wherein the back portion of the first shoulder strap includes an upper section and a lower section, wherein the lower section is wider than the upper section, wherein the back portion of the second shoulder strap includes an upper section and a lower section, wherein the lower section is wider than the upper section, and wherein at least a portion of the lower section of the first shoulder strap overlaps at least a portion of the lower section of the second shoulder strap to form an overlap section, wherein the back portion of the first shoulder strap and the back portion of the second shoulder strap each include an inner edge, wherein the inner edge of the back portion of the first shoulder strap is not secured to the lower section of the back portion of the second shoulder strap, and wherein the inner edge of the back portion of the second shoulder strap is not secured to the lower section of the back portion of the first shoulder strap, whereby the overlap section can be lowered such that the wearer can use a bathroom, a back bridge connecting the back portion of the first shoulder strap to the back portion of the second shoulder strap, wherein the first shoulder strap is permanently connected to the second shoulder strap by the back bridge, such that when the wearer lowers the overlap section to use the bathroom the first and second shoulder straps are not removed from the left and right shoulders.

2. The garment of claim 1 wherein the lower sections of the first and second shoulder straps are connected to the bottom portion along a common seam.

3. The garment of claim 2 wherein the back portion of the first shoulder strap and the back portion of the second shoulder strap each include an inner edge, wherein the back bridge includes a lower edge, and wherein the inner edge of the back portion of the first shoulder strap, the lower edge of the back bridge and the inner edge of the back portion of the second shoulder strap form a criss-cross open edge.

4. The garment of claim 3 wherein the criss-cross open edge includes a first end and a second end, wherein the common seam includes a first end and a second end, and wherein the first end of the criss-cross open edge coincides with the first end of the common seam and the second end of the criss-cross open edge coincides with the second end of the common seam.

5. The garment of claim 2 wherein the lower sections of the first and second shoulder straps become gradually wider closer to the bottom portion.

6. The garment of claim 5 wherein the lower section of the back portion of the first shoulder strap includes an inner edge and an outer edge, wherein the inner edge forms an angle between approximately 70° and approximately 75° with the common seam, and wherein the lower section of the back portion of the second shoulder strap includes an inner edge and an outer edge, wherein the inner edge forms an angle between approximately 70° and approximately 75° with the common seam.

7. The garment of claim 2 wherein the common seam has a length of between about 10 cm and about 20 cm.

8. A garment comprising: a bottom portion that includes first and second leg openings, wherein the bottom portion includes a front part and a back part, first and second shoulder straps that each have a front portion extending upwardly from the front part and a back portion extending upwardly from the back part, wherein the first and second shoulder straps each include a shoulder portion that connects the front portion to the back portion, wherein the back portion of the first shoulder strap includes an upper section and a lower section, wherein in the lower section is wider than the upper section, wherein the back portion of the second shoulder strap includes an upper section and a lower section, wherein the lower section is wider than the upper section, wherein at least a portion of the lower section of the first shoulder strap overlaps at least a portion of the lower section of the second shoulder strap, wherein the lower sections of the first and second shoulder straps are connected to the bottom portion along a common seam, wherein the back portion of the first shoulder strap and the back portion of the second shoulder strap each include an inner edge, wherein the inner edge of the back portion of the first shoulder strap is not secured to the lower section of the back portion of the second shoulder strap, and wherein the inner edge of the back portion of the second shoulder strap is not secured to the lower section of the back portion of the first shoulder strap, whereby the overlap section can be lowered such that the wearer can use a bathroom, a back bridge connecting the back portion of the first shoulder strap to the back portion of the second shoulder strap, wherein the first shoulder strap is permanently connected to the second shoulder strap by the back bridge, such that when the wearer lowers the overlap section to use the bathroom the first and second shoulder straps are not removed from the left and right shoulders, wherein the back bridge includes a lower edge, and wherein the inner edge of the back portion of the first shoulder strap, the lower edge of the backs bridge and the inner edge of the back portion of the second shoulder strap form a criss-cross open edge.

9. The garment of claim 8 wherein the criss-cross open edge includes a first end and a second end, wherein the common seam includes a first end and a second end, and wherein the first end of the criss-cross open edge coincides with the first end of the common seam and the second end of the criss-cross open edge coincides with the second end of the common seam.

10. The garment of claim 9 wherein the inner edge of the back portion of the first shoulder strap forms an angle between approximately 70° and approximately 75° with the common seam, and wherein the inner edge of the back portion of the second shoulder strap forms an angle between approximately 70° and approximately 75° with the common seam.

11. The garment of claim 1 wherein the first and second shoulder straps each include the shoulder portion, and wherein the back bridge is positioned closer to the shoulder portions than the overlap section.

12. The garment of claim 1 wherein the overlap section includes an upper overlap point, and wherein the upper overlap point is positioned adjacent the wearer's lower back when the garment is worn.

* * * * *